US005454756A

United States Patent [19]

Ludwig

[11] Patent Number: 5,454,756

[45] Date of Patent: Oct. 3, 1995

[54] CLEAN ROOM VENTILATION SYSTEM

[75] Inventor: Craig S. Ludwig, Portland, Oreg.

[73] Assignee: PACE Company, Portland, Oreg.

[21] Appl. No.: 188,091

[22] Filed: Jan. 28, 1994

Related U.S. Application Data

[63] Continuation-in-part of Ser. No. 1,785, Jan. 7, 1993, which is a continuation of Ser. No. 748,229, Aug. 21, 1991, Pat. No. 5,192,348.

[51] Int. Cl.[6] ..... F24F 13/068

[52] U.S. Cl. ..... 454/296; 55/385.2; 55/484; 454/293

[58] Field of Search ..... 55/385.2, 484, 55/494, 507; 454/292, 293, 294, 295, 296, 297, 298, 187

[56] References Cited

U.S. PATENT DOCUMENTS

| | | | |
|---|---|---|---|
| 2,172,771 | 9/1939 | Norris . | |
| 2,662,743 | 12/1953 | Frenger | 454/296 X |
| 3,280,984 | 6/1964 | Sexton et al. . | |
| 3,432,999 | 12/1967 | Ernst-Schraner . | |
| 3,487,766 | 1/1968 | Wood . | |
| 3,630,008 | 12/1971 | Revell . | |
| 3,715,578 | 2/1973 | Wood et al. . | |
| 3,730,072 | 5/1973 | Soderlund et al. | 454/298 |
| 3,740,934 | 6/1973 | Shuler . | |
| 3,776,121 | 12/1973 | Truhan . | |
| 3,782,082 | 1/1974 | Smith et al. . | |
| 3,975,995 | 8/1976 | Shuler . | |
| 3,984,221 | 10/1976 | Cotton . | |
| 4,094,232 | 6/1978 | Howorth . | |
| 4,175,936 | 11/1979 | Lough et al. . | |
| 4,178,159 | 12/1979 | Fecteau | 55/473 X |
| 4,217,121 | 8/1980 | Fichter | 454/296 X |
| 4,267,769 | 5/1981 | Davis et al. . | |
| 4,334,899 | 6/1982 | McConnell | 55/507 X |
| 4,409,889 | 10/1983 | Burleson . | |
| 4,461,205 | 7/1984 | Shuler . | |
| 4,518,405 | 5/1985 | Lough et al. | 55/483 X |
| 4,549,472 | 10/1985 | Endo et al. . | |
| 4,554,766 | 11/1985 | Ziemer et al. . | |
| 4,580,381 | 4/1986 | Sodec et al. . | |
| 4,600,419 | 7/1986 | Mattison . | |
| 4,603,618 | 8/1986 | Soltis . | |
| 4,608,066 | 8/1986 | Cadwell, Jr. . | |
| 4,671,811 | 6/1987 | Cadwell, Jr. et al. . | |
| 4,678,487 | 7/1987 | Cadwell, Jr. et al. . | |
| 4,683,699 | 8/1987 | Larsson . | |
| 4,710,208 | 12/1987 | Ziemer et al. . | |
| 4,713,099 | 12/1987 | Schroeder | 55/494 X |
| 4,724,749 | 2/1988 | Hedrick . | |
| 4,745,710 | 5/1988 | Davis | 52/12 |
| 4,747,341 | 5/1988 | Hedrick . | |
| 4,776,263 | 10/1988 | Lokander et al. | 55/484 X |
| 4,819,549 | 4/1989 | Gillingham et al. . | |
| 4,860,420 | 8/1989 | Cadwell, Jr. et al. . | |
| 4,865,803 | 9/1989 | Dillmann et al. | 376/314 |
| 4,883,513 | 11/1989 | Monson et al. . | |
| 4,890,544 | 1/1990 | Aalpo et al. | 454/297 X |
| 4,946,484 | 8/1990 | Monson et al. . | |
| 4,986,050 | 1/1991 | Brunetti et al. . | |
| 5,192,348 | 3/1993 | Ludwig | 55/385.2 |

FOREIGN PATENT DOCUMENTS

| | | | |
|---|---|---|---|
| 0207027 | 12/1986 | European Pat. Off. . | |
| 2624252 | 12/1987 | France . | |
| 297656 | 12/1987 | Japan | 454/297 |
| 456754 | 10/1988 | Sweden . | |

OTHER PUBLICATIONS

JP60241212, *Patent Abstracts of Japan*, Nov. 1985.
JP62138635, *Patent Abstracts of Japan*, Jun. 1987.

*Primary Examiner*—Harold Joyce
*Attorney, Agent, or Firm*—Klarquist Sparkman Campbell Leigh & Whinston

[57] ABSTRACT

A clean room ventilation system having a diffuser panel attached to a ceiling grid, with a filter element positioned well above the panel. The diffuser panel is perforated throughout its area with increased size and/or density of perforations in a peripheral region to provide increased airflow beneath the ceiling grid. The peripheral regions may further be angled to create a lateral airflow beneath the ceiling grid.

10 Claims, 5 Drawing Sheets

CLEAN ROOM VENTILATION SYSTEM

REFERENCE TO RELATED APPLICATION

This application is a continuation-in-part of U.S. patent application Ser. No. 08/001,785 filed Jan. 7, 1993, which is a continuation of Ser. No. 748,229, filed Aug. 21, 1991, now abandoned, U.S. Pat. No. 5,192,348, issued Mar. 9, 1993.

TECHNICAL FIELD

This invention relates to clean room ventilation systems, and more particularly to diffusers for reducing airflow turbulence.

BACKGROUND AND SUMMARY OF THE INVENTION

In addition to the filtering effect provided by clean room ventilation systems, such systems are generally designed to reduce turbulence by providing a generally laminar airflow pattern. In a laminar flow clean room, air typically flows downward from the ceiling to the floor so that a contaminant particle, such as might be shed by a worker, would be drawn directly downward to be removed by a filter. Thus, such a particle would spend no more than a few seconds in the clean room. Where the airflow is turbulent, there are eddies that create localized upward airflow currents. A contaminant particle might be trapped in such an eddy for up to several minutes. Consequently, turbulent airflow generally results in a higher concentration of contaminants at any given time and creates a greater likelihood that such contaminants might come to rest on sensitive equipment or materials.

Perforated diffuser panels are commonly used in clean room ceilings to reduce turbulence and to provide a generally laminar airflow. Such diffuser panels are typically positioned below ceiling-mounted filter elements, preferably with at least a small space in between. Although air may exit the filter element at uneven pressures across the element, the diffuser panel creates a small backpressure which equalizes the air pressure in the space above the panel. The air then passes through perforations in the diffuser panel, with the perforations acting as point sources having generally equal flow rates. Although there is turbulence immediately below the diffuser panel due to the "nozzle effect" of the perforations, such turbulence is quickly dissipated. Typically, such turbulence becomes negligible at a distance below the diffuser panel equal to several times the diameter of the perforations.

However, while a single diffuser panel can provide an effectively laminar airflow away from boundaries or obstructions, clean room ventilation systems are typically constructed with multiple filter elements mounted in a grid system to permit modular manufacturing and assembly. In such a system, each filter element is separated from adjacent filter elements by a "dead zone" occupied by a grid structural element creating an obstruction to air flow with a corresponding airflow dead zone immediately below. As a result, air flowing downward from the periphery of a filter element tends to be drawn into the airflow dead zone and form a turbulent vortex having an upward airflow beneath the grid element. A rule of thumb predicts that a turbulence zone extends downstream of an obstacle by a distance of about four times the obstacle's width. Thus, in typical systems having a frame or grid element with a width of two to three inches, the turbulence zone may extend 12 inches below the ceiling surface, substantially impairing the clean room function.

An existing approach to reduce the turbulence between filter elements is to extend a V-shaped shroud beneath the grid element. Such a shroud is usually in the form of a "tear drop" fluorescent light fixture cover, and functions like the trailing edge of an airplane wing, allowing the laminar flow regions from adjacent filter elements to rejoin more smoothly with reduced turbulence. This approach typically reduces the turbulence zone to within about 7 inches of the ceiling surface, an improvement, but still problematic. In addition, tear drop light fixtures have the disadvantage of further reducing ceiling height, which is typically at a premium due to the substantial ducting and equipment required above the ceiling. Also, such light fixtures create an obstacle to modular sub-dividing walls that preferably hang immediately below the ceiling surface without a substantial gap. Other concerns in clean room ventilation systems include the difficulty of removing and replacing components of the system, the difficulty of installing very large systems, particularly at the junctions of subsystems, and the expense of stocking replacement filters when different types of filters are used in a particular facility. Also, there are disadvantages that are proportional to the velocity passing through the filters. These include particle shedding, reduced filter life, and noise due to pleat vibration and flutter, as well as the energy and equipment cost associated with the air flow resistance or pressure drop of the filter.

From the foregoing it will be recognized that there is a need for an air diffuser panel that overcomes these drawbacks of the prior art by providing an increased or directional airflow at the periphery of the diffuser panels to fill in the dead space below the structural elements and to create a balanced net airflow that becomes generally laminar within close proximity to the ceiling surface. This need includes the provision of a large filter area per unit area of the clean room, easily removable and replaceable components, and a uniform airflow to minimize contamination. The present invention satisfies this need.

The foregoing additional features and advantages of the present invention will be more readily apparent from the following detailed description which proceeds with reference to the accompanying drawings.

DETAILED DESCRIPTION OF A PREFERRED EMBODIMENT

Figure 1:
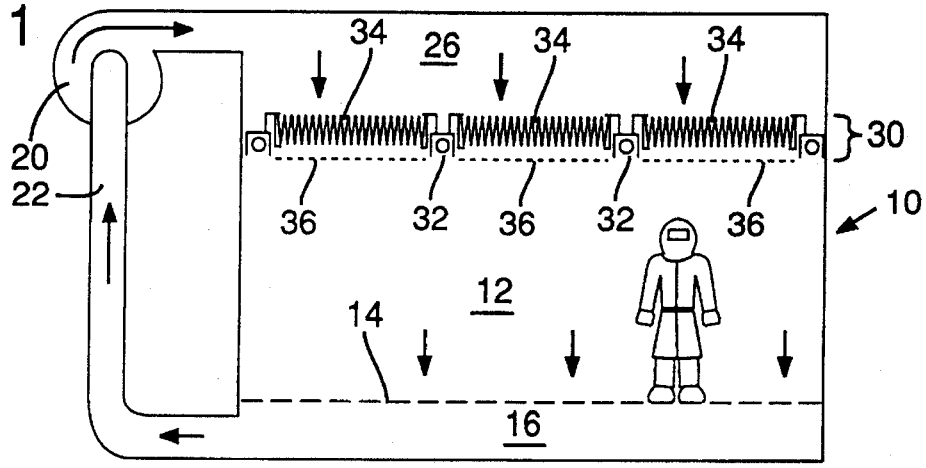
FIG. 1 is a sectional side view of a clean room system according to the present invention.

FIG. 1 shows a clean room system 10 for providing an uncontaminated downward laminar airflow in an enclosed chamber 12. The chamber includes a perforated floor 14 with a subspace 16 below the floor 14. A blower 20 draws air through a duct 22 in communication with the subspace 16 and expels it at a higher pressure into a plenum 26 above the chamber 12.

A ceiling 30 separates the plenum 26 from the chamber 12. The ceiling 30 generally includes a rigid grid structure formed of grid elements 32, with the grid elements arranged orthogonally to define a matrix of rectangular spaces. A set of rectangular filter elements 34 is carried by the grid elements 32 with each filter element 34 occupying a rectangular space formed by the grid elements. Each filter element 34 is sealed to the grid to prevent airflow between the plenum 26 and clean room chamber 12 from circumventing the filters at its edges. A set of diffuser panels 36 is attached to the ceiling 30, with each diffuser panel 36 being positioned below and generally coextensive with a filter element 34. Each diffuser panel 36 is preferably a rigid perforated sheet for providing a non-turbulent laminar airflow when air is forced through it from a volume of higher pressure above the sheet.

Alternatively, the diffuser panel may be a rigidly supported air-permeable membrane (not shown) formed of flat filter paper media such as a long-strand polyester fiber sheet. Such a sheet may be installed in conjunction with a perforated panel as discussed above, and may be folded and formed by bending the peripheral portions at an angle so that air passing perpendicularly through the peripheral portions of the sheet is directed outwardly. The desired higher volume peripheral flow rate may be provided by manufacturing a composite membrane with a more highly permeable material in the peripheral portions than in the central portions. Alternatively, a single membrane may be perforated at its periphery to provide increased airflow.

Figure 2:
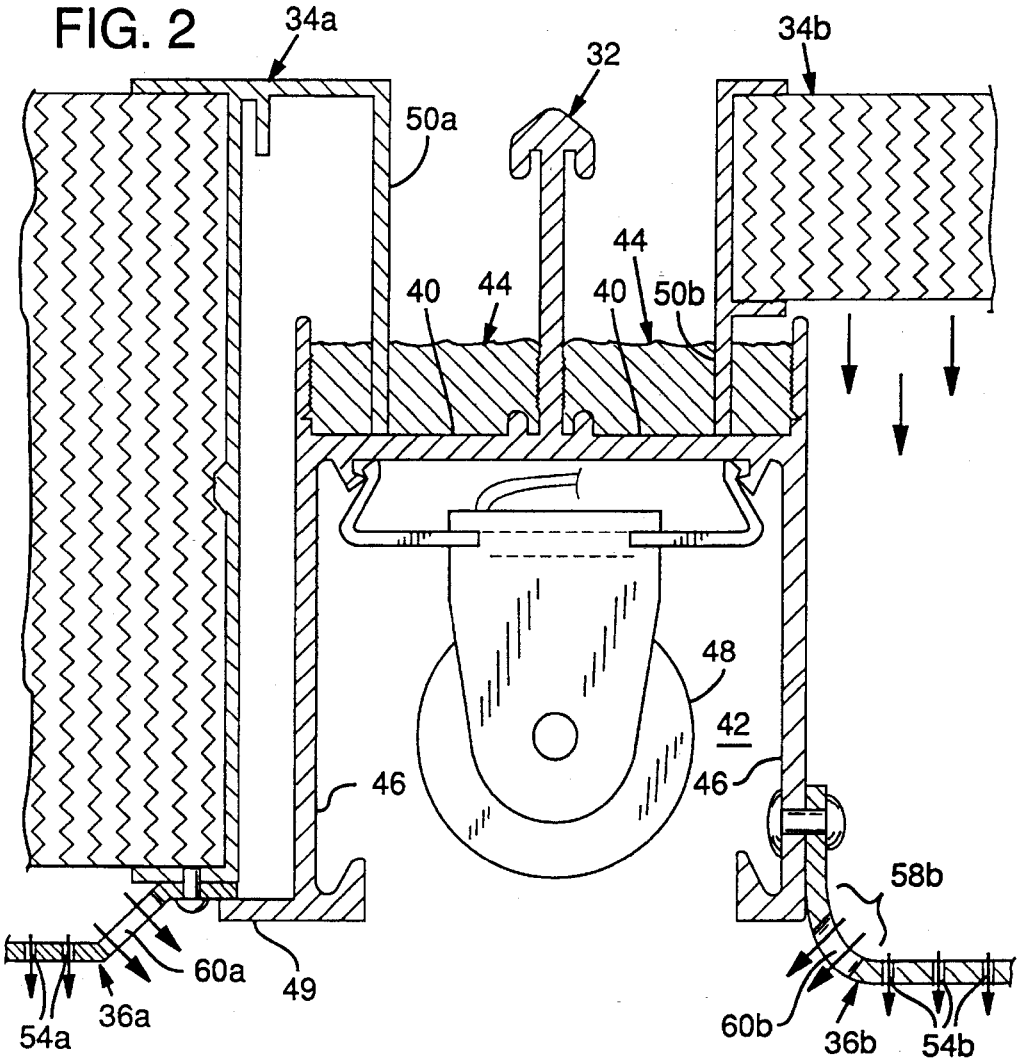
FIG. 2 is an enlarged sectional side view of a grid element junction between adjacent filter elements in the system of FIG. 1, showing alternative filter and diffuser configurations.
Figure 2A:
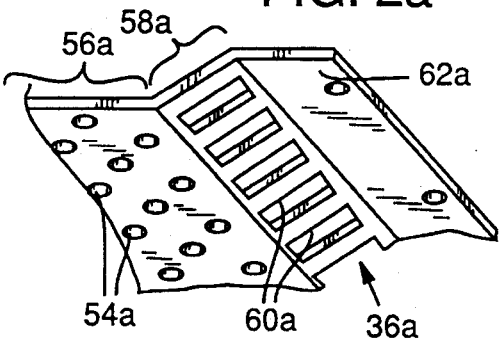
FIG. 2*a* is an enlarged, fragmentary view of a diffuser panel of FIG. 2.
Figure 2B:
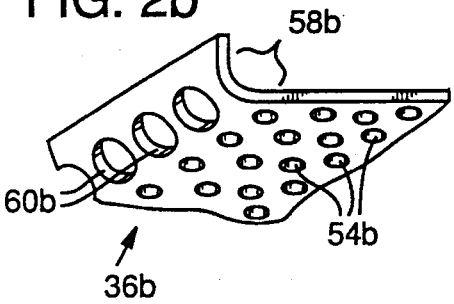
FIG. 2*b* is an enlarged, fragmentary view of an alternative diffuser panel of FIG. 2.

As shown in FIG. 2, the grid element 32 has a constant cross-section and is preferably formed of extruded aluminum. The grid element 32 defines a pair of upwardly facing troughs 40, each trough being filled with a gel-like sealant 44. The grid element 32 further defines a large downwardly facing channel 42 defined by opposed, spaced apart grid sidewalls 46. The channel 42 is generally sized to fit a fluorescent light fixture 48 entirely therein. A ledge 49 may extend laterally from the sidewall 46 at its lower edge as shown on the left sidewall in FIG. 2. The ledge 49 provides a resting or attachment point for the filter element **34*a*, and prevents airflow in the space between the filter element and the sidewall 46**.

FIG. 2 shows the filter elements **34*a*, 34*b* in two alternative configurations. Preferably, only one of these configurations would be selected and exclusively used throughout each clean room installation. A hanging-type filter 34*a* includes a peripheral flange 50*a* depending downwardly from the top of the filter 34*a* so that a substantial portion of the filter hangs below the flange. A standing-type filter 34*b* includes a peripheral flange 50*b* extending directly downward from the lower edges of the filter, with the entire filter element standing above the flange. Because a flush ceiling surface is desired for functional and aesthetic reasons, a hanging filter 34*a* is used when a diffuser panel 36*a* is to be attached directly to the filter; a standing filter element 34*b* is used when a diffuser panel 36*b* may be attached directly to the lower edge of the grid sidewall 46. To prevent airflow from circumventing the filter elements 34 and contaminating the clean room chamber 12, each element is installed with its peripheral flange 50 received in the gel sealant 44 contained in the troughs 40**.

Generally speaking, each diffuser panel 36 is preferably a perforated metal sheet having equally sized and spaced-apart perforations 54 distributed over the majority of the panel's area in its central region. In the preferred embodiment, the total area of the perforations accounts for about 20% of the panel area. This percentage is known as the free area of the panel. The panel 36 may be useful with a free area anywhere within a wide range. A free area of less than 10% is suitable when a high backpressure and flow resistance is desired; a free area of greater than 90%, such as provided by a honeycomb panel, is useful when substantial backpressure is not necessary. The panel 36 must provide sufficient backpressure to create a lateral airflow that equalizes differences between high pressure zones and low pressure zones below the filter 34. To permit this lateral flow, the diffuser 36 is preferably spaced below the filter element 34, although the diffuser may be mounted adjacent the lower surface of a filter that permits lateral air flow within itself.

FIG. **2*a* shows a first alternative perforated panel 36*a* suitable for attachment to the filter element 34*a*. The panel includes a central portion 56*a* populated by a plurality of evenly spaced, equally sized central perforations 54*a*. A peripheral portion 58*a* surrounds the central portion 56*a* on all sides and defines an array of peripheral perforations 60*a*. The peripheral perforations 60*a* are larger and more closely spaced than the central perforations 54*a*. Consequently, the peripheral portion has a substantially higher percentage free area than the central portion 56*a* and will permit a greater airflow rate per unit area than the central portion. The peripheral portion 58*a* is angled upward from the central portion 56*a* so that air passing perpendicularly therethrough will be directed peripherally away from the central portion. This deflection angle is preferably about 30 degrees, although the angle may range up to 90 degrees, or be eliminated altogether. The diffuser panel 36*a* is preferably terminated by an edge flange 62*a* that is parallel to the center portion 56*a* and attachable to the edge of the filter element 34*a*. Alternatively, the edge flange 62*a* may rest on the grid ledge 49**.

FIG. **2*b* shows an alternative diffuser panel 36*b* suitable for attachment directly to the grid sidewall 46 in conjunction with the standing-type filter element 34*b*. The panel 36*b* is bent perpendicularly at its periphery to create a radiused peripheral portion 58*b* populated by peripheral perforations 60*b*. A plurality of central perforations 54*b* populate the panel and are sized substantially smaller than the peripheral perforations 60***b*. This permits the diffuser panel 36*b* to achieve the same increased peripheral airflow provided by the diffuser panel 36*a*. Similarly, the peripheral airflow is directed away from the center of the diffuser panel 36*b*, because the peripheral perforations 60*b* are centered approximately at the midpoint of the radiused bend of the panel so that they face outward.

Figure 3:
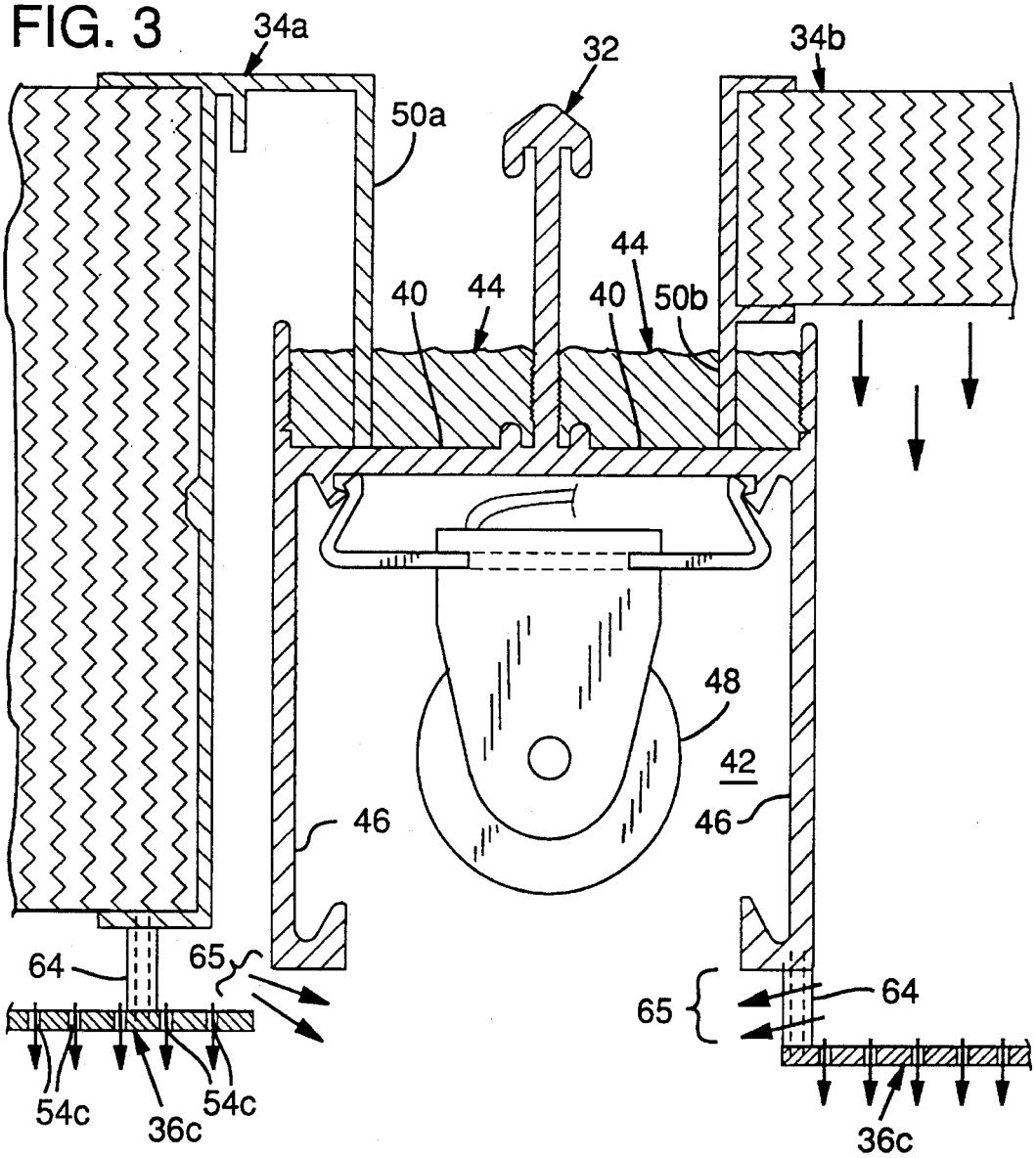
FIG. 3 is an enlarged sectional side view of a grid element junction between adjacent filter elements in the system of FIG. 1, showing additional alternative filter and diffuser configurations.

FIG. 3 shows an alternative diffuser panel 36*c* that is uniformly populated by central perforations 54*c* throughout its area. The panel 36*c* is spaced below the filter element 34*a* so that air may escape laterally beyond the edge of the diffuser panel 36*c*, and below or beside the lower edge of the grid sidewall 46. The space is sized to create a higher flow volume in the lateral airstream than through the central perforations 54*c*. The panel may be directly attached to the lower edge of the filter element 34*a* by spacer posts 64 or other suitable means. The same diffuser panel 36*c* may be used in conjunction with a standing filter element 34*b*, as shown on the right side of FIG. 3, with the panel being attached to and spaced below the lower edge of the grid sidewall 46. In either embodiment of FIG. 3, each panel 36*c* and corresponding grid sidewall define a side gap 65 having an effective free area of 100%.

Figure 4:
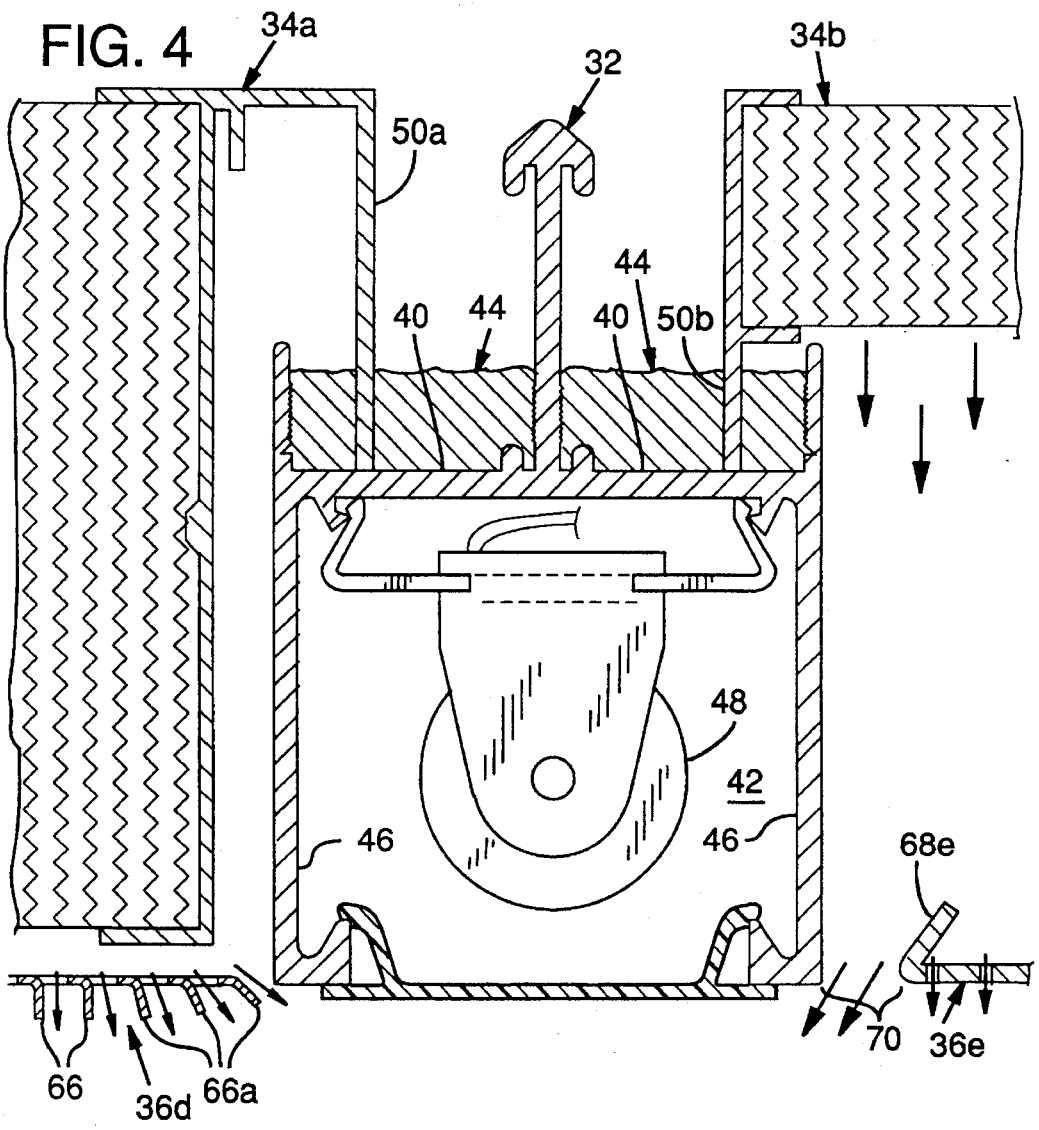
FIG. 4 is an enlarged sectional side view of a grid element junction between adjacent filter elements in the system of FIG. 1, showing further alternative filter and diffuser configurations.

FIG. 4 shows additional alternative diffuser panel configurations. A diffuser panel 36*d* includes vertically oriented vanes 66 in the central portion of the panel and angled vanes 66*a* in the peripheral portion of the panel for directing air peripherally away from the center of the panel. The angled vanes 66*a* are angled from the vertical in correspondence with their proximity to the edge of the panel. In this embodiment, the airflow volume is not substantially increased at the periphery, but the directional effect alone adequately fills in the area underneath the grid element to substantially reduce turbulence.

A further alternative diffuser panel 36*e* is shown on the right side of FIG. 4. In this embodiment, a diffuser panel 36*e* has a peripheral flange 68*e* that is bent upwardly and inwardly at an acute angle to leave a peripheral gap 70 between the panel 36*e* and the grid sidewall 46, thus permitting increased airflow at the periphery. The bent angle of the flange also serves to direct air into the area beneath the grid element 32, acting as a vane and a funnel.

Figure 5:
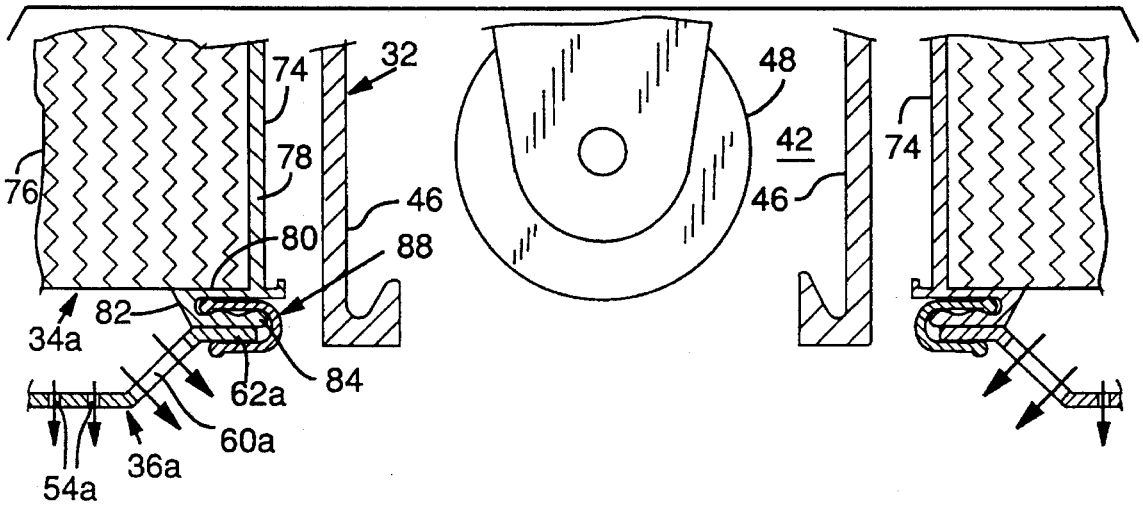
FIG. 5 is an enlarged sectional side view of a junction between a filter element and a diffuser panel according to the present invention.

FIG. 5 illustrates a filter configuration that permits the removable attachment of the diffuser panel 36*a* from below and without requiring removal of the filter element 34*a*. The filter element 34*a* has an extruded aluminum filter frame 74 that peripherally surrounds a mass of filter material 76. The frame 74 includes a frame sidewall 78 with a lower frame ledge 80 attached at a lower edge thereof and extending perpendicularly inward toward the center of the filter panel. A slanted wall 82 is attached to the inner edge of the lower frame ledge 80 with the slanted wall extending downward and peripherally outward to permit airflow to spread outward therebelow. An attachment flange 84 is attached to the lower end of the slanted wall 82 and extends peripherally outward therefrom to be spaced below the lower frame ledge 80. The attachment flange 84 is integral with the filter frame 74 so that it extends around the entire periphery of the filter element 34*a*. The attachment flange 84 is positioned entirely below the filter frame 74 so that it does not extend peripherally outward past the frame element to interfere with the grid sidewall 46 of the grid element 32.

The diffuser panel 36*a* may be positioned for attachment to the filter element 34*a* by positioning the diffuser panel edge flange 62*a* against the attachment flange 84. A U-shaped clip 88 defines a gap for receiving the attachment flange 84 and edge flange 62*a* to bias the flanges together to secure the diffuser panel 36*a* to the filter element 34*a*. The clip 88 may be formed of spring steel or extruded aluminum with a clip extending the full length of each side of the diffuser panel.

As a result of the attachment system shown in FIG. 5, the diffuser panel may be removed and re-attached from below. It is not necessary to remove or disturb the filter element, to enter the plenum 26 or to shut down the clean room system to effect such an operation. The clip 88 has the added aesthetic advantage over conventional screws and rivets in that it does not require drilled holes or visible fasteners.

By providing increased and directional airflow to fill in the area beneath the grid element 32, the diffuser panel 36 effectively provides a net downward airflow beneath the grid element more nearly equal to that which would be provided by replacing the grid elements with an infinite uniform filter element and perforated panel. The airflow below the grid element 32 has sufficient pressure and volume to permit the vertical laminar flow layers flowing from the central portions of the panels to remain vertical and laminar. These layers are thus not drawn upwardly into vortexes beneath the grid element 32.

The initial turbulence beneath the grid element 32 is further minimized by providing a symmetrical airflow from the opposite sides of the grid element 32. Thus, the laterally directed peripheral airstreams will impinge on one another, substantially cancelling their lateral flow and resulting in a generally less turbulent, downward flow. The increased airflow provided by the diffuser panel peripheral regions should create a net airflow below the grid element that is generally equal to the net airflow per unit area in the central regions of the diffuser panels. The velocity of the airflow from the peripheral regions need not be greater than velocity through the central perforations. Only the net airflow rate (e.g. the air volume flow per unit time through unit horizontal area) of the peripheral region need exceed that of the central region. Also, as noted above, this airflow rate differential may act alone to achieve the goals of the invention, or the directional effect alone may provide the same advantages. In the preferred embodiment, both principles act cooperatively.

Figure 6:
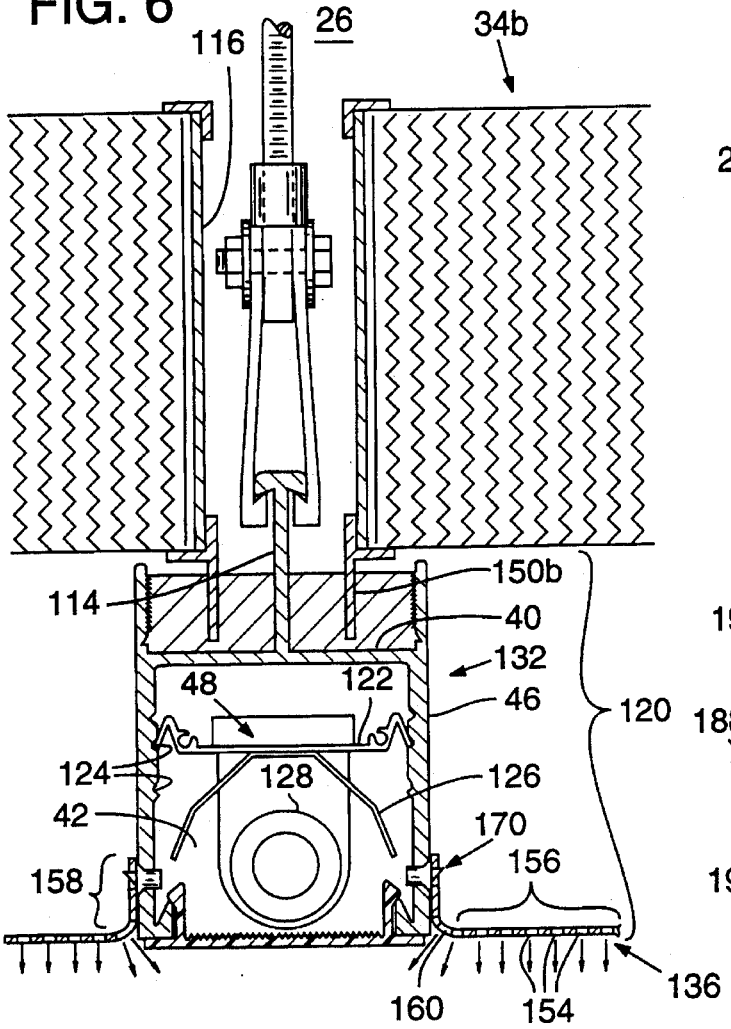
FIG. 6 is a sectional side view of an alternative grid element junction between adjacent filter elements.

FIG. 6 illustrates an embodiment that shares many design features with the embodiment illustrated in the right half of FIG. 2. It employs a standing-type filter 34*b* having a peripheral flange 50*b* that rests in a gel-filled trough 40 of a grid element 132.

In certain applications, the use of a standing filter element 34*b* has advantages over a hanging filter element such as shown in the left side of FIG. 2. In a given grid system with a two-foot by four-foot nominal panel size, a standing filter element 34*b* has a larger transmissive area than a hanging filter element. A hanging filter must fit within the smaller space defined by the sidewalls 46 of the grid element. A standing filter may be larger than the rectangular aperture defined by the sidewalls, as shown in FIG. 6, and need only have clearance with respect to the vertically protruding central suspension wall 114, and any hanger clamps to which it is attached. The use of a larger active filter media area has several advantages. For a given flow rate within the clean room, it provides a reduced velocity through the filter, reducing the vibration and flutter of filter pleats. Such vibration can cause damage, reduce filter life, and generate unwanted shedding of particles. Also, the reduced velocity lowers the back pressure generated by the filter's resistance to air flow, providing commensurate energy savings and potentially permitting the use of smaller, more cost-effective air handling equipment for generating air flow. Finally, the reduced velocity results in lower noise within the clean room.

A standing filter is also advantageous in that it is considered a standard size, permitting a clean room user to stock only a single type of filter for replacements, and for disaster recovery in the event all filters within a clean room need to be replaced.

A standing-type filter is not sensitive to small lateral positional displacements. On the other hand, hanging filters such as shown in the left side of FIG. 2 have a peripheral air outlet that may be fixed to the filter, and which therefore may undesirably offset, or even potentially blocked if the filter is misaligned.

A further advantage of standing-type filters is their reduced sensitivity to leakage. Each filter normally comprises a frame 116 that surrounds and supports the filter media on all four sides. The sides of each frame are connected at miter joints at each corner, and these joints are occasionally susceptible to minor leakage. Air leaking through a crack in a joint may not be fully filtered, and may therefore contain unwanted contaminants. In hanging filters, the joints are largely on the "clean" side of the filter below the supporting flange. Consequently, contamination leaking from a crack will enter the clean room below. On the other hand, any contaminants escaping the edge of a standing filter such as shown in FIG. 6, will remain on the "dirty" side of the ceiling, within the plenum 26 above the filters.

A further advantage of standing type filters is that their use permits a reduction of the effective obstruction width of the grid element 32. Hanging filters include frame portions at their lower edges that block air flow immediately adjacent the grid element. Thus, the obstruction width is effectively the distance between the edges of the active filter media on opposite sides of the grid element. On the other hand, with a standing filter air may flow immediately past the grid element without additional obstructions, reducing overall turbulence, and improving clean room effectiveness. A substantial gap 120 is provided between the lower surface of the filter media and a diffuser screen 136, which is attached to the grid element 132 to be flush with the lower edges of the grid element. The gap 120 permits lateral air flow. In the preferred embodiment, the gap is about 3.5 inches or about one-thirteenth the long axis length of the screen. Preferably, the gap is at least one-fiftieth of the screen length, with best results being achieved at a gap greater than one-twentieth of the screen length. Thus, any differences in air flow over the area of a particular filter will tend to be averaged as air flows through the gap. This particularly permits air to flow readily to the edges and corners, enhancing the uniformity effect provided by the peripheral apertures.

Because a standing filter is elevated above the sidewalls 46 of the grid element 132, there is no dead space between the filter frame and the side wall in which air may be trapped, as shown in the left half of FIG. 2. Without air flow continually passing through a space, contaminant particles may remain suspended for prolonged periods of time, with particles accumulating, then threatening contamination when later dislodged.

Figure 8:
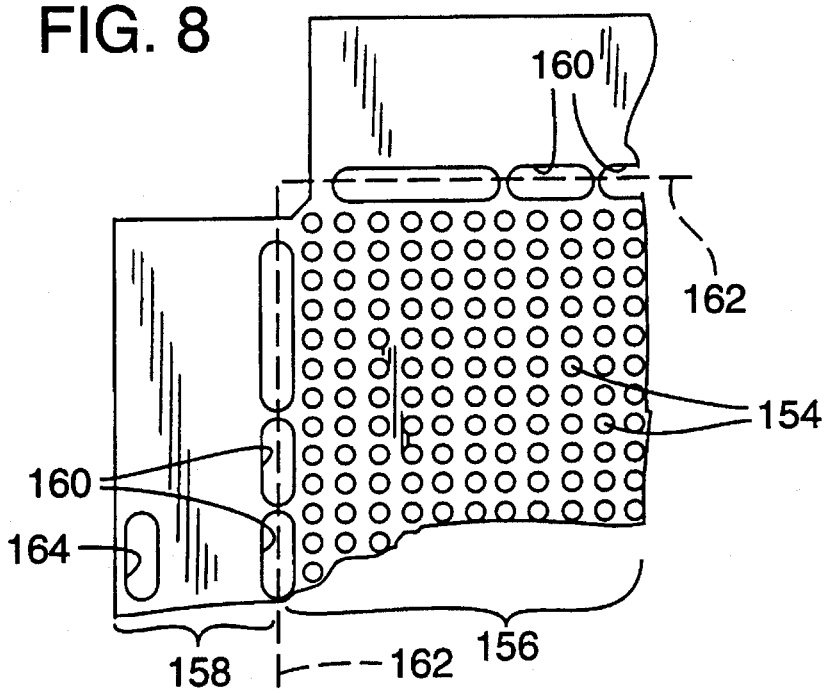
FIG. 8 is a fragmenting plan view of a partially manufactured diffuser screen according to the embodiment of FIG. 6.
Figure 9:
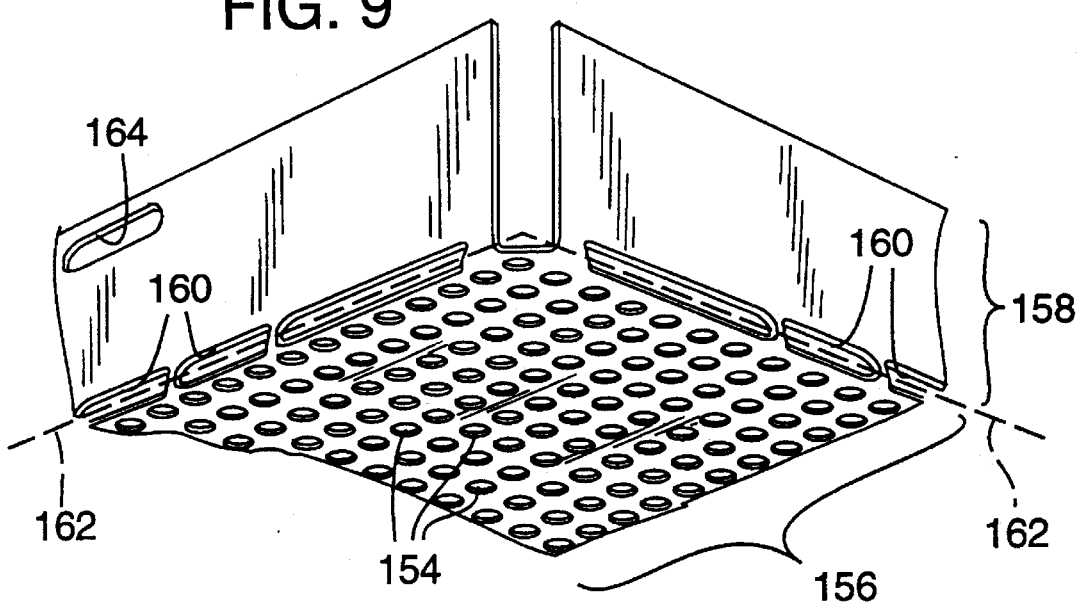
FIG. 9 is a fragmentary perspective view of a fully manufactured diffuser screen according to the embodiment of FIG. 6.

As shown in FIGS. 8 and 9, the light fixture 48 includes a planar frame 122 that consists of a horizontal sheet articulated at its edges in the form of V-shaped troughs that permit the edges of the frame to be biased inwardly. The grid element 32 defines several depressions 124 running along opposite sides of the interior facing surfaces of the side walls 46. The light fixture frame edges 122 may be stably seated within the depressions to secure the light fixture. The flexibility of the frame permits removal and replacement of the light fixture. The light fixture further includes a downwardly-open articulated reflector channel 126 that is positioned below the frame and above a fluorescent light tube 128 to direct light from the tube in a downward direction.

As shown in FIGS. 8 and 9, each diffuser screen 136 is a perforated metal panel having a central portion 156 defining a plurality of uniformly sized and spaced central perforations 154 and having a surrounding peripheral portion 158 defining a plurality of peripheral perforations 160. The peripheral edges of the screen are bent upward at a 90° angle, with the peripheral perforations defining a junction or bend line 162. In the preferred embodiment, the screen is formed of a sheet of aluminum having a thickness of 0.05 inch, and with the central perforations being 3/32 inch diameter holes on 3/16 inch centers. A steel panel of 0.032 inch thickness may also be used. Although the peripheral portion 158 is illustrated without such holes in the preferred embodiment, the screen may be formed of uniformly perforated sheet stock, with the peripheral perforations 160 being punched to enlarge the existing perforations. Each peripheral perforation is an oblong ¼ inch wide and ½ inch long, with ⅛ inch radius at each end. The peripheral perforations are aligned end to end in single rows near each edge of the screen. A rectangular or other elongated shape may alternatively be used. The peripheral perforations are spaced apart on 9/16 inch centers so that a small amount of material remains between each pair of peripheral perforations to connect the central screen portion to the upwardly-bent free edges of the screen. The endmost peripheral perforations are somewhat larger than the others to provide enhanced air flow from the corners of the panels.

Figure 7:
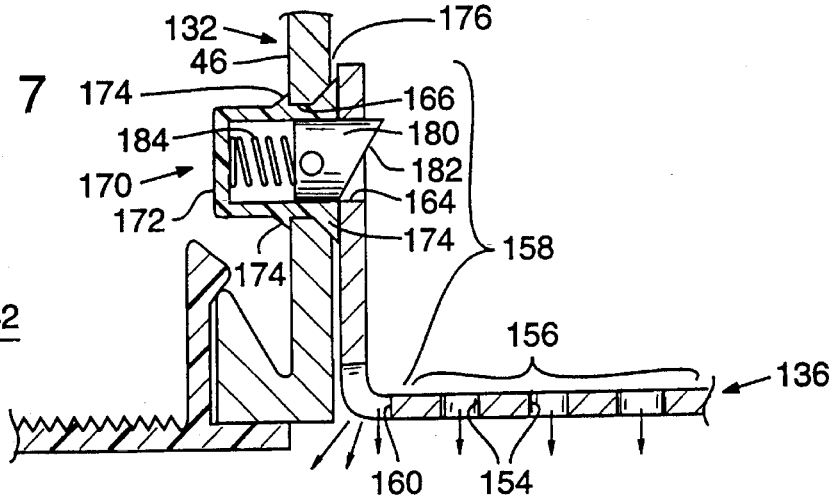
FIG. 7 is an enlarged sectional side view of a connection between a diffuser screen and a grid element of the embodiment of FIG. 6.

As shown in FIG. 7, the screen further defines an attachment slot 164 near the upper edge of the upwardly bent peripheral portion 158. Four such slots are provided, one at each end of the long edges of the screen 136. Preferably, the slot is a 9/32 inch by ½ inch oblong centered ¼ inch from the edge of the screen, and is oriented with its major axis in a horizontal direction.

As further shown in FIG. 7, the side wall 46 of the grid element 132 defines a rectangular latch mounting hole 166 having a chamfered aperture at the surface of the side wall 46 facing the screen 136. A latch mechanism 170 is received within the hole 166. The latch mechanism includes a housing 172 having flexible barbs 174 along each side to engage the interior surface of side wall 46, and to prevent removal of the latch after insertion from the exterior of the grid element through hole 166. The housing includes a sloped shoulder 174 that engages the chamfered portion of aperture 166 to limit insertion. The shoulder 174 protrudes slightly from the outer surface of the side wall, preventing contact between the screen and the side wall. The protruding shoulder defines a gap 176 that prevents metal-to-metal contact between the screen and the grid element, avoiding particle shedding that might otherwise occur in response to vibrations generating rubbing between the components. The latch mechanism is preferably made of a low-shedding and low-outgassing material such as an ultra-high molecular weight plastic.

The latch mechanism 170 includes a bolt 180 having a sloped cam surface 182 facing away from the grid element and slightly downward. The bolt reciprocates within a chamber defined in the latch housing 172 and is spring biased outwardly by a spring 184. The latch mechanism is configured such that the screen may be installed from below, with the upper edge of the screen's periphery camming the bolt into the housing until the attachment slot 164 is registered with the bolt, upon which the bolt extends into the slot. Thereupon, the screen rests upon the upper edge of the bolt and may be removed only by inserting a thin shim between the latch and the screen to depress the bolt. Removal of the screen is best accomplished by depressing both bolts on one side of a screen, lowering that side of the screen, and lifting it away from the latches on the opposite side.

Figure 10:
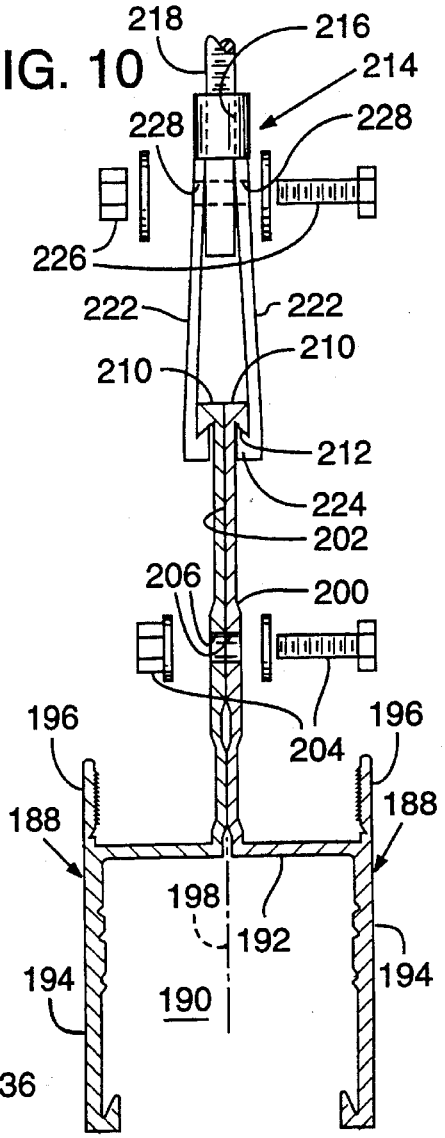
FIG. 10 is a sectional side view of a junction between grid elements at the periphery of ceiling modules constructed according to the embodiment of FIG. 6.

There is a trade-off between the desire to minimize the amount of on-site construction required to install a ceiling, and to avoid the need to deliver extremely large structures to the site of installation. To balance these goals, ceiling grid structures are preferably manufactured in modules that are delivered to a site for final assembly. In the preferred embodiment, each module is a rectangular grid capable of supporting 24 two-foot by four-foot filter panels, although other sizes and shapes may be used effectively. The overall dimensions of the module are eight feet by twenty-four feet, with the filters being arranged in a twelve-by-two matrix, the long axes of the filters being perpendicular to the long axis of the module. For installations in which multiple modules are used, the modules are installed side-by-side, with adjacent modules abutting each other. FIG. 10 illustrates a perimeter grid element assembly formed by a junction between perimeter grid components or elements 188 of adjacent modules. The grid element on the left comprises the perimeter of a first module (not shown) that extends to its left; the element on the right is the leftmost perimeter of a second module extending to its right. When joined as shown, the grid elements 188 define a downwardly open channel 190. With two perimeter grid elements 188 joined as illustrated, an assembly is formed that has essentially the same form, fit and function as a standard grid element 132.

Each perimeter grid element 188 comprises a horizontal wall 192 with a side wall 194 depending downwardly from one edge of the horizontal wall, with a trough wall 196 extending upwardly from the same edge of the horizontal wall 192. A suspension wall 200 extends vertically upward from the opposite edge of the horizontal wall 192 and includes a flat outer surface 202 that faces away from the module and the horizontal wall 192. The outer surface may be arranged in face-to-face relation with the outer surface of a corresponding grid element on an adjacent module, as shown. A junction plane 198 defines the plane of contact, as well as a plane of mirror symmetry; the elements are mirror images of each other.

A threaded fastener 104 is inserted through holes 106 defined at an intermediate height in the suspension walls 200 to clamp the suspension walls together, creating a junction between adjacent modules. Preferably, caulk or other sealant is provided between the outer surfaces 202 to ensure that air does not pass downwardly between the perimeter grid elements 188 when installed.

The upper edge of each suspension wall 200 is terminated by a hook 210 that extends laterally away from the suspension wall from the side opposite of the outer surface. Each hook has a lower surface 212 that faces generally downward and somewhat toward the suspension wall 200. Together, a pair of assembled perimeter grid elements 188 form a T-shaped cross-section from which the assembly may be suspended. The slope of the lower surfaces provide a "serif" shape to provide stable suspension. A hanger 214 has a sleeve defining a vertical threaded bore 216 that is adjustably connected to a vertical threaded rod 218, which is in turn suspended from the overhead building ceiling to support the grid and filter assembly. The hanger 214 includes a pair of downwardly-depending arms 222, terminated at their lower ends with inwardly-protruding barbs 224. The barbs have upwardly and outwardly facing surfaces that stably engage the lower surfaces 212 of the grid members hooks 210. Because the clamp arms 222 are somewhat flexible, the grid may readily be installed or removed by spreading apart the arms to permit the hooks 210 to pass through the gap between the ends of the arms.

To ensure that the arms are not inadvertently spread after installation, a threaded fastener 226 clamps the arms together. An aperture 228 is defined at an intermediate position on each arm below the threaded bore 216, with the fastener passing through the apertures. The same suspension arrangement may be used with a standard grid element as shown in FIG. 6.

Having illustrated and described the principles of my invention by what is presently a preferred embodiment, it should be apparent to those skilled in the art that the illustrated embodiment may be modified without departing from such principles. I claim as my invention not only the illustrated, but all such modifications, variations and equivalents thereof as come within the true spirit and scope of the following claims.

I claim:

1. An air diffuser panel for attachment to a clean room ceiling structure, the air diffuser panel comprising:

a central region defining a plurality of central perforations of a first size;

a peripheral region angularly disposed upward with respect to the central region, and joined thereto along a junction; and a plurality of peripheral perforations defined at the periphery of the air diffuser panel, at least some of said peripheral perforations being larger than the central perforations, and at least some of the peripheral perforations being defined in registration with the junction between the central region and the peripheral region.

2. The air diffuser panel of claim 1 wherein the peripheral region includes means for attaching the air diffuser panel to a clean room ceiling structure.

3. The air diffuser panel of claim 1 wherein the peripheral region is disposed at a right angle with respect to the central region.

4. The air diffuser panel of claim 1 wherein the air diffuser panel has a generally rectangular shape, and the peripheral region includes four segments, one at each edge of the air diffuser panel.

5. The air diffuser panel of claim 1 wherein the air diffuser panel is articulated at the junction with a bend radius less than ¼ inch.

6. A clean room air system comprising:

a support grid having grid elements defining a plurality of panel spaces for transmitting air flow;

a plurality of diffuser panels each defining a plurality of perforations and being sized to substantially cover a panel space; and a moveable latch mounted on the grid and having a first position for engaging and supporting one of said panels, and a second position for releasing one of said panels, said latch including a fixed protruding spacer portion for preventing direct contact between the panel and the grid.

7. The system of claim 6 wherein the latch is biased to the first position such that a panel may be stably retained.

8. The system of claim 6 wherein the latch is mounted to a portion of the grid facing the panel space, with a movable portion of the latch extending into the panel space.

9. The system of claim 6 wherein the grid includes a lowest portion defining a horizontal plane, and wherein the panel is attachable to the grid to stably reside at or above the horizontal plane.

10. The system of claim 6 wherein the panel includes a central region defining a plurality of central openings of the first size, and a peripheral region defining a plurality of peripheral openings of a larger second size.

* * * * *